United States Patent [19]

Summach

[11] 4,341,410

[45] Jul. 27, 1982

[54] SUPPORTING FRAME FOR DETACHABLY HOLDING A BAG TYPE RECEPTACLE

[76] Inventor: Harley R. W. Summach, P.O. Box 29, Asquith, Saskatchewan, Canada, S0K 0J0

[21] Appl. No.: 147,837

[22] Filed: May 8, 1980

[51] Int. Cl.[3] ..... A01K 29/00

[52] U.S. Cl. ..... 294/1 B; 248/99; 294/55

[58] Field of Search ..... 294/1 B, 1 BA, 1 BB, 294/1 R, 55; 15/104.8, 257.1, 257.4, 257.7; 141/108, 328, 390, 391; 150/1, 2, 6, 49; 248/95, 99, 100, 101

[56] References Cited

U.S. PATENT DOCUMENTS

| | | | |
|---|---|---|---|
| 1,265,996 | 5/1918 | Cerny | 248/99 |
| 2,213,937 | 9/1940 | Tompkins et al. | 248/99 |
| 3,754,785 | 8/1973 | Anderson | 294/1 BA X |
| 3,778,097 | 12/1973 | Dorzan | 294/1 BA |
| 3,848,841 | 11/1974 | Rafeldt | 248/99 |
| 3,942,832 | 3/1976 | Haas | 294/55 |
| 4,019,768 | 4/1977 | Niece | 294/1 B |
| 4,023,842 | 5/1977 | Harvey | 294/1 R |

FOREIGN PATENT DOCUMENTS

| | | | |
|---|---|---|---|
| 2379652 | 10/1978 | France | 294/1 BB |

*Primary Examiner*—Johnny D. Cherry
*Attorney, Agent, or Firm*—Stanley G. Ade

[57] ABSTRACT

A frame comprises a handle and a pair of legs extending therefrom with the handle being substantially U-shaped and having a taut wire spanning the distal ends of the legs. A plastic or paper bag is engaged between the legs with one side of the open end folded over the taut wire and the legs and the forefinger of the hand holding the handle engaging the other side of the open end and tensioning same against the wire. This holds the bag in the open position. The primary use is for scooping up waste material from animals such as dogs but it can also be used to hold a bag upright in the open position with one hand so that the bag can be filled with material by the other hand. It can also be used in industry for sanitary sampling of granular, comminuted, or liquid materials. In one embodiment the frame is foldable for easy storage.

4 Claims, 8 Drawing Figures

SUPPORTING FRAME FOR DETACHABLY HOLDING A BAG TYPE RECEPTACLE

BACKGROUND OF THE INVENTION

This invention relates to new and useful improvements in supporting frames for plastic, cloth or paper bags and although it is designed primarily for the cleaning up of waste material from pets such as dogs or the like, nevertheless it can be used to hold the top of the bag in the open position so that it can be filled readily and easily. It can also be used for sampling materials in industry using the device as a scoop.

Many attempts have been made to provide devices to hold bags in the open position particularly when same are being used to collect animal waste and the like. Most of these utilize a handle with means to hold the bag in the open position but those known to the applicant require a specially made bag with folded down portions and having dimensions specifically designed to fit the holder. Examples of such bags are shown in U.S. Pat. Nos. 4,047,746, 4,103,952 and 4,146,259.

In these particular examples, if the bag is not of precise size then it will not be held firmly upon the supporting frame.

The present invention overcomes these disadvantages and other disadvantages inherent in such constructions by providing a frame which is suitable for use with bags of various sizes inasmuch as the user tensions the bag around the frame as the user is holding the handle portion.

In accordance with the invention there is provided a holder for plastic, cloth or paper bags comprising in combination a handle portion, a pair of legs extending therefrom in spaced apart relationship and a relatively taut bracing member spanning the distal ends of said legs, said handle portion including an open portion adjacent the junction of the legs to the handle for anchoring and tensioning the associated bag with the forefinger of the hand holding the handle thereby maintaining the bag in the open position, the upper wall of the bag being folded over the bracing member and the legs and being detachably held thereby.

Another advantage of the invention is that a clip may be provided for temporary storage of a folded unused bag so that the device is always ready for use.

Another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

The primary purpose of the invention is to market a relatively inexpensive kit that is light, portable, attractive and small enough that it may or may not be concealed when not in use. The kit is adapted to be used to pick up small or large quantities of litter from one's pet in a public place and to provide a means of conveying the substance easily to the nearest litter container for disposal.

However, it will of course be appreciated that the device may be used for other purposes. For example, in household use, the bag may be held in the upright position and maintained with the top fully opened so that material can readily be placed within the bag for storage purposes.

Alternatively it can be used in industry for the rapid and easy sampling of bulk materials such as grain, comminuted or ground materials, liquids and the like in which a sample may be scooped up readily and easily and in a sanitary manner.

Proceeding therefore to describe the invention in detail, reference should first be made to FIGS. 1–5 in which the holder collectively designated 10 includes a handle portion 11 with a pair of legs 12 extending therefrom.

Figure 1:
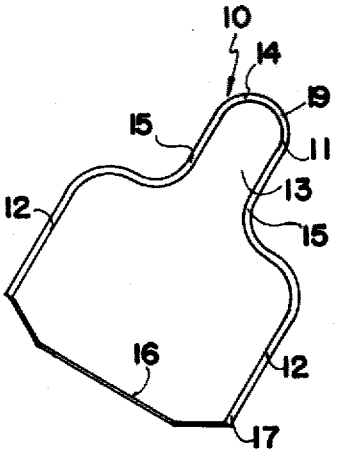
FIG. 1 is an isometric view of one embodiment of the holder per se.
Figure 2:
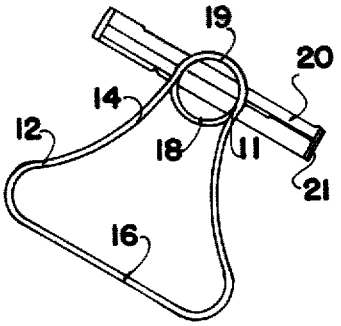
FIG. 2 is an isometric view of alternative embodiment showing a folded bag detachably secured to the handle.
Figure 3:
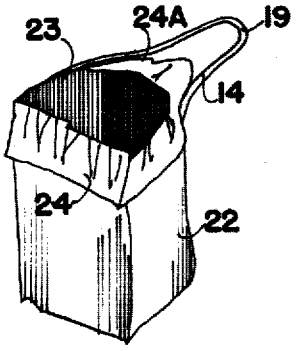
FIG. 3 is an isometric view of the holder with a bag in place, showing the bag in a substantially upright or vertical position.

It is essential that the handle include an open area 13, the purpose of which will hereinafter be described and it is therefore desirable that the handle be made in the form of a U-shaped loop 14 with the legs 12 being formed integrally therewith and extending therefrom as clearly shown in FIGS. 1 and 2.

The legs 12 are in spaced apart relationship one with the other, and preferably a distance greater than the spaced apart relationship of the inner end 15 of the handle portion.

A taut wire 16 spans the distal end 17 of the legs and acts as a bracing member, the wire being secured to the legs by any conventional means so that the wire is held in the desired position. This may include winding the wire around the distal ends of the legs, angulating the ends of the wire 16 and inserting same within apertures within the ends of the legs or any other suitable fastening means.

If desired, a spring clip 18 may be formed integrally with or secured to the upper end 19 of the handle to act as a temporary holding device for a folded plastic, cloth or paper bag 20 thus storing the bag until it is required. It may also include an elongated flat stick 21 to assist in the movement of the material into the bag.

The bag 22 may be made from plastic or paper and, within limits, can be of any convenient size. It includes the open upper end 23 and the upper end portion 24 of the wall forming the bag.

In operation, the handle is held in one hand in a flat position as the device would lay on a table for example. The bag 22 is slipped through the opening between the legs and the taut wire 16 with the open end 23 uppermost and approximately 3 to 5 inches of the top wall 24 is then folded over the wire 16 and over the legs 12 as clearly shown in FIG. 3.

Depending upon the position of the hand holding the handle 14, the forefinger or thumb of the user engages the folded over rear portion 24A between the handle ends 15 and pulls it towards the closed end 19 thus tensioning the bag over the wire and the legs and maintaining the upper end 23 in the fully open position so that one hand not only supports the holding frame but also maintains the bag in the desired relationship with the force exerted on the bag by means of the thumb or forefinger transmitting a resultant force to the taut wire 16 thus securing the bag to the rim of the device by means of friction to the extent that the bag may now be filled with a substance of reasonable density.

Figure 4:
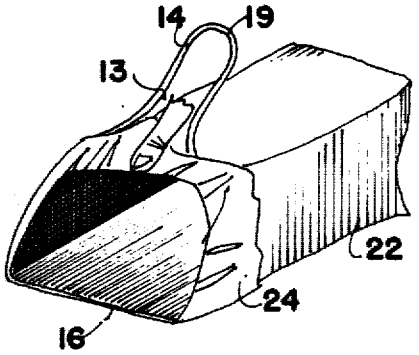
FIG. 4 is a view similar to FIG. 3 but showing the bag in the waste material pick up position.
Figure 5:
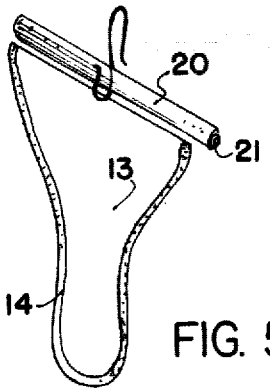
FIG. 5 is an isometric view showing an alternative method of holding the bag in the stored position.

When used as a waste material pick up device, it is positioned at approximately 45° upon the ground as shown in FIG. 4 and slid along the surface. The substance slips over the bag 22 where it covers the taut wire 16 of the rim area. This may be assisted by the aforementioned pusher stick 21 if desired.

When the bag is full, or whenever the material has been collected, the stick may be dropped into the bag which may then be released and dropped through the bottom of the device or pulled through the top of the device guided by a portion of the bag which has not come in contact with the substance bagged. It will be appreciated that the device will not become contaminated because it is fully covered by the bag and that the outside surface of the bag will not be contaminated because of the folded down portion 24.

The material thus bagged may be transported easily to the nearest litter container for disposal and because the device is clean, it may then be returned to the user's pocket or clipped to any convenient portion of a belt or the like.

Figure 6:
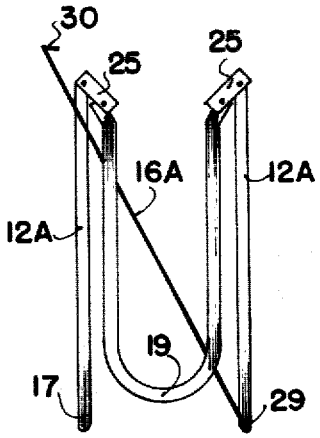
FIG. 6 is a front elevation of an alternative embodiment shown in the folded position.
Figure 7:
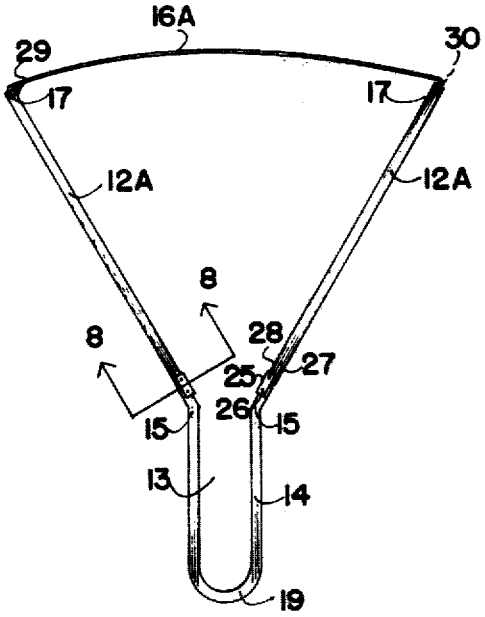
FIG. 7 is a view similar to FIG. 6 but showing the holder in the extended or working position.
Figure 8:
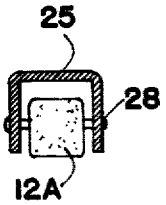
FIG. 8 is a section through one of the clips substantially along the line 8—8 of FIG. 7.

The preferred embodiment is shown in FIGS. 6 and 7 in which the handle portion 14 is formed as previously described with the legs 12A being pivotally secured to the ends 15 of the handle by means of U-shaped clips 25. The ends 15 of the handle are inserted within the ends of the clip 25 and pivoted thereto by means of pivot pin 26 and the inner ends 27 of the legs are also inserted within the U-shaped clips and pivoted thereto by means of pivot pins 28.

The taut wire 16A is pivotally secured by one end thereof to the distal end 17 of one of the legs 12A by bending the wire as shown by reference character 29 and engaging same through an aperture formed in the distal end of the leg. The other end is detachably securable to the distal end 17 of the other leg and one method of detachable securement is shown in FIG. 7. The distal end 30 of the wire is angulated as shown in the detachably engaged position within a drilling (not illustrated) formed in the distal end 17 of the leg.

When folded as shown in FIG. 6, the wire is detached and the legs are folded to the configuration shown with the wire being positioned as illustrated.

It should be stressed that a significant feature of the device is the fact that the bag does not have to be specially made to fit the frame as if the bag is larger than the optimum size, the access is easily folded over the legs and taut wire and tensioned by the thumb or forefinger in the gap 13 between the legs.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim is:

1. A holder for plastic, cloth or paper bags comprising in combination a handle portion, a pair of legs extending therefrom in spaced apart relationship and a relatively taut bracing member spanning the distal ends of said legs, said handle portion including an open portion adjacent the junction of the legs to the handle portion and extending into the handle portion whereby the area between the pair of legs opens into the said open portion adjacent said junction of the legs to said handle portion for anchoring and tensioning the associated bag with the forefinger of the hand holding the handle portion thereby maintaining the bag in the open position, the upper wall of the bag being folded over the bracing member and the legs and being detachably held thereby, said handle portion comprises a curved portion having a closed end portion and a pair of side portions extending from the closed end portion and defining said open portion, said legs being pivotally attached by one end thereof one each to each one of said side portions and movable from a folded, stored position to an extended position and vice versa, and means to pivotally connect each of said legs to one of said side portions, said means including a U-shaped clip, said side portion being pivotally secured within said U-shaped clip adjacent one end of said clip, said legs being pivotally secured within said U-shaped clip adjacent the other end of said clip, said bracing member being detachably secured to the distal end of said legs.

2. The invention according to claim 1 which includes clip means on said handle portion for detachably holding a folded bag for storage purposes.

3. The invention according to claim 2 in which said bracing member comprises a wire pivotally secured by one end thereof to the distal end of one of said legs and being detachably secured by the other end thereof to the distal end of the other of said legs when said legs are in the extended position.

4. The invention according to claim 1 in which said bracing member comprises a wire pivotally secured to one end thereof to the distal end of one of said legs and being detachably secured by the other end thereof to the distal end of the other of said legs when said legs are in the extended position.

* * * * *